US007455594B1

(12) United States Patent
Priegel

(10) Patent No.: US 7,455,594 B1
(45) Date of Patent: Nov. 25, 2008

(54) FERRULE AND SLEEVE ASSEMBLY

(75) Inventor: Jack C. Priegel, El Paso, TX (US)

(73) Assignee: Wind Gear Direct, LLC, El Paso, TX (US)

( * ) Notice: Subject to any disclaimer, the term of this patent is extended or adjusted under 35 U.S.C. 154(b) by 0 days.

(21) Appl. No.: 11/756,912

(22) Filed: Jun. 1, 2007

(51) Int. Cl.
*A63B 57/00* (2006.01)

(52) U.S. Cl. ..... 473/176

(58) Field of Classification Search ..... 473/174–179
See application file for complete search history.

(56) References Cited

U.S. PATENT DOCUMENTS

| | | | | |
|---|---|---|---|---|
| 1,676,954 | A | 7/1928 | Kannemann | |
| 3,348,797 | A | 10/1967 | Turbyfill | |
| 3,732,845 | A | 5/1973 | Istre | |
| 4,114,879 | A | 9/1978 | Oiler | |
| 4,120,496 | A | 10/1978 | Niina | |
| 4,928,417 | A | 5/1990 | Boudreau | |
| 5,249,384 | A | 10/1993 | Dark, Jr. | |
| 5,351,950 | A | 10/1994 | Frankum | |
| 5,382,018 | A | 1/1995 | Browne | |
| 5,398,927 | A | 3/1995 | O'Sullivan | |
| 6,113,503 | A | 9/2000 | Brookman | |
| 6,409,608 | B1 | 6/2002 | Garske | |
| 6,478,687 | B1 | 11/2002 | Colonello | |
| 6,712,714 | B2 | 3/2004 | Joswick | |
| 6,722,997 | B2 | 4/2004 | Gilmour | |
| 6,726,170 | B2 | 4/2004 | Luo | |
| 6,726,575 | B1 | 4/2004 | Thorp et al. | |
| 6,767,289 | B2 | 7/2004 | Porter | |
| 6,902,491 | B2 | 6/2005 | Barlow et al. | |
| 6,939,239 | B1 * | 9/2005 | Ash | 473/176 |
| 7,033,279 | B2 | 4/2006 | Garske | |
| 7,033,280 | B2 | 4/2006 | Hottle et al. | |
| 2002/0094878 | A1 | 7/2002 | Porter | |
| 2002/0198059 | A1 * | 12/2002 | Gilmour | 473/176 |
| 2006/0189401 | A1 | 8/2006 | Garske | |

FOREIGN PATENT DOCUMENTS

| | | | |
|---|---|---|---|
| JP | 11239627 | A * | 9/1999 |

OTHER PUBLICATIONS

Reliable Golf Course Supplies, 2006 Golf Course Supply Catalog, p. 23.

* cited by examiner

*Primary Examiner*—Mark S Graham
(74) *Attorney, Agent, or Firm*—Fitch, Even, Tabin & Flannery

(57) ABSTRACT

A ferrule and coupling member assembly for mounting a flag pole is disclosed. The ferrule and coupling member are both formed from a non-metallic material, such as a ceramic composite material, which aids in wear-resistance and provides a low coefficient of friction between the surfaces. In addition, debris will be less likely to become lodged in a gap between the ferrule and coupling member and particulate matter on the golf course will not be able to gouge or scratch the ferrule or the coupling member.

15 Claims, 4 Drawing Sheets

FERRULE AND SLEEVE ASSEMBLY

FIELD

The apparatus relates to a mounting device for a flag pole, and in particular, to a ferrule and coupling member for mounting the flag pole in a golf cup.

BACKGROUND

In order to support a golf flag pole within a golf cup, the flag pole is typically attached to a ferrule, which is usually formed from a soft metal, such as aluminum, zinc or a zinc alloy, at a lower end of the flag pole. The metal ferrule facilitates insertion of the flag pole into a receiving hole positioned in the center of the golf cup, which is often fabricated out of plastic. In this manner, the flag pole is positioned to display the pin flag and hole location to an approaching golfer.

When the traditional metal ferrule is received in the plastic golf cup hole, there can be a tendency for the two components to stick together. When this occurs, golfers can pull a portion of or the entire golf cup out of the ground when they attempt to remove the pin. This problem is even more pronounced in a desert or high humidity environment where sand or moisture can be trapped between the cup and ferrule to allow the ferrule and cup to stick together.

In an effort to reduce sticking between the ferrule and cup, various modifications to the ferrule have been employed. For instance, ribs have been provided along the sides of the ferrule body so as to reduce the contact area between the ferrule and cup. In addition, the side walls of the ferrule have been tapered inwardly to further minimize contact area and permit easier pole removal. However, these solutions have the shortcomings that the ribs often leave insufficient contact area to provide a stable coupling, and the tapered side walls may result in excessive leaning of the flag pole or render the flag susceptible to movement even in moderate breezes.

As golf is a sport primarily undertaken outdoors, under normal weather conditions, different types of debris or other material may blow into the golf cup. Leaves, sand, small rocks, grass clippings, dirt, and the like may regularly fall into the golf cup and become trapped between the ferrule and the ferrule receiving hole. This causes debris to become jammed between the ferrule and the cup, which can cause them to stick together and even result in the golfer at least partially removing the cup from the ground. In addition, debris such as sand or rocks jammed between the plastic walls forming the receiving hole and the soft metal of the ferrule can cause damage to the cup and ferrule that expedites wear and corrosion.

The sand and dirt on a golf green often contain fragments of flint or quartz. In addition, many courses use torpedo sand—fine aggregate with sharp edges that promotes sharp, straight blades of grass—as a component of the golf green. These fragments may become lodged between the ferrule and the receiving hole, causing them to stick together and further creating abrasions as they are rubbed between the metal ferrule and the plastic sleeve. Over time, as the golf flag pole is repeatedly removed and then placed back within the receiving hole, any of these fragments lodged between the ferrule and receiving hole may wear down the plastic of the golf cup and cause damage to the soft metal ferrule and/or wear its outer diameter to a smaller dimension. All of this may result in the ferrule and inner wall of the receiving hole having insufficient contact, which leads to a flag pole that may lean, shift, or even fall under certain conditions. This corrosion and abrasion problem may necessitate periodic replacements of both the metal ferrules and the plastic golf hole cups.

Debris accumulated in the cup hole may also result in a flag pole and attached ferrule that cannot be properly inserted into the receiving hole because the debris interferes with the proper insertion of the ferrule into the hole. The situation can leave the golf flag pole insufficiently supported in the cup and may cause the pin to tilt or even fall over in a breeze. A downed or tilted pin is not useful to an approaching golfer because it provides misleading information about the exact pin location.

One attempt to address these issues involves installing a metal insert into the golf hole cup to receive the metal ferrule. While the metal insert avoids wearing the plastic cup itself through repeated removal and insertion of the ferrule, such a solution still has several drawbacks. The metal-to-metal wear can still scratch or damage the ferrule and insert, and if the ferrule metal and insert metal are different, any moisture in the cup could lead to other issues such as galvanic wear. Furthermore, the metals that are typically used for ferrules or inserts (i.e., zinc, aluminum, bronze) are still soft compared to much of the sand, rocks, or other particulate matter that commonly falls into a golf cup. Therefore, even with a metal insert this debris can still lead to scratches, small deformations, and accelerated wear and corrosion of the metal ferrule and metal insert.

Accordingly, there is a desire for a mounting device for a flag pole and a golf cup that provides wear resistance and allows ease of pole insertion and removal without disturbing the cup embedded within the ground.

DETAILED DESCRIPTION

Figure 1:
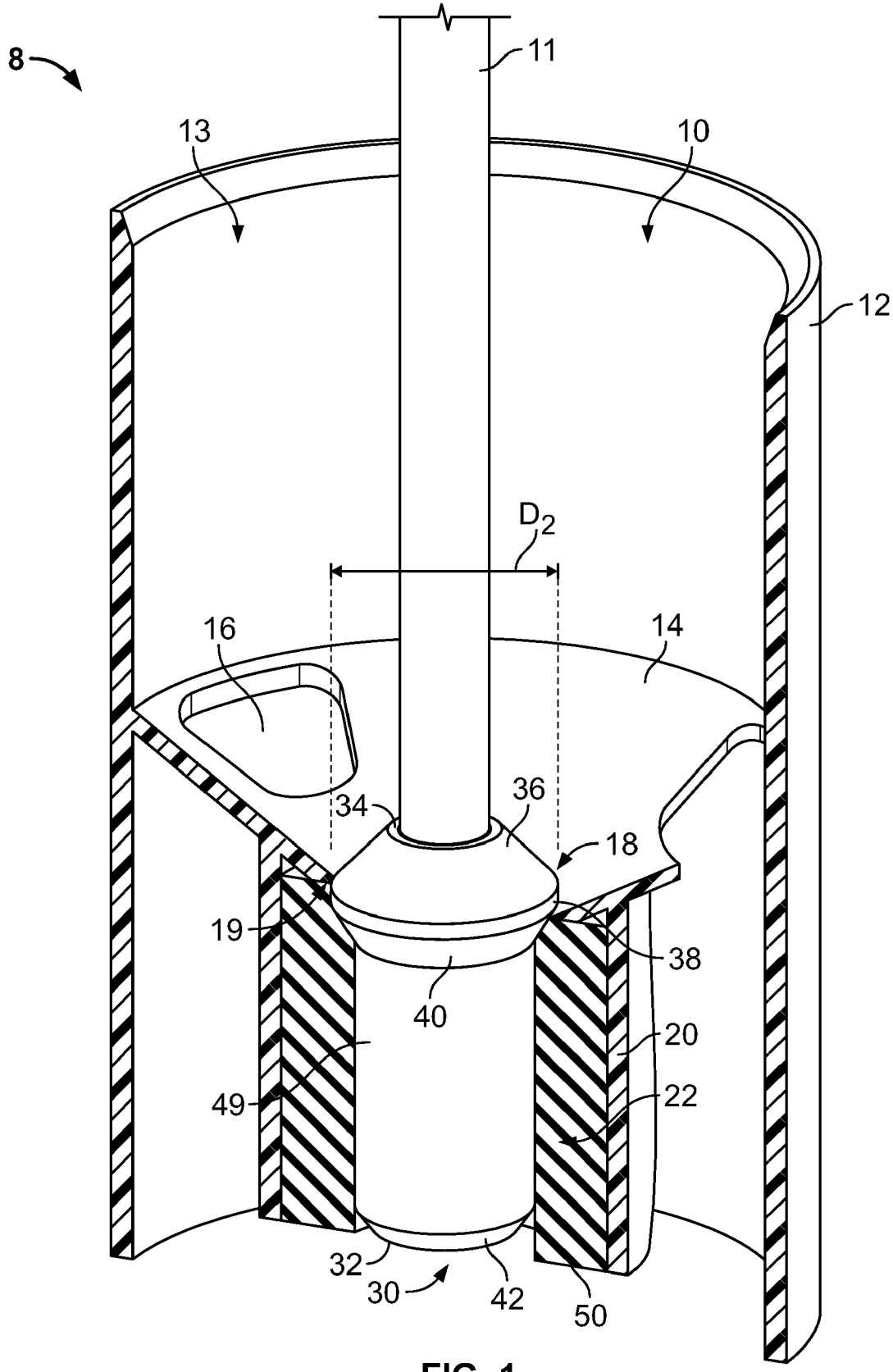
FIG. 1 is a cross-sectional view of an exemplary golf cup hole inner assembly.
Figure 2:
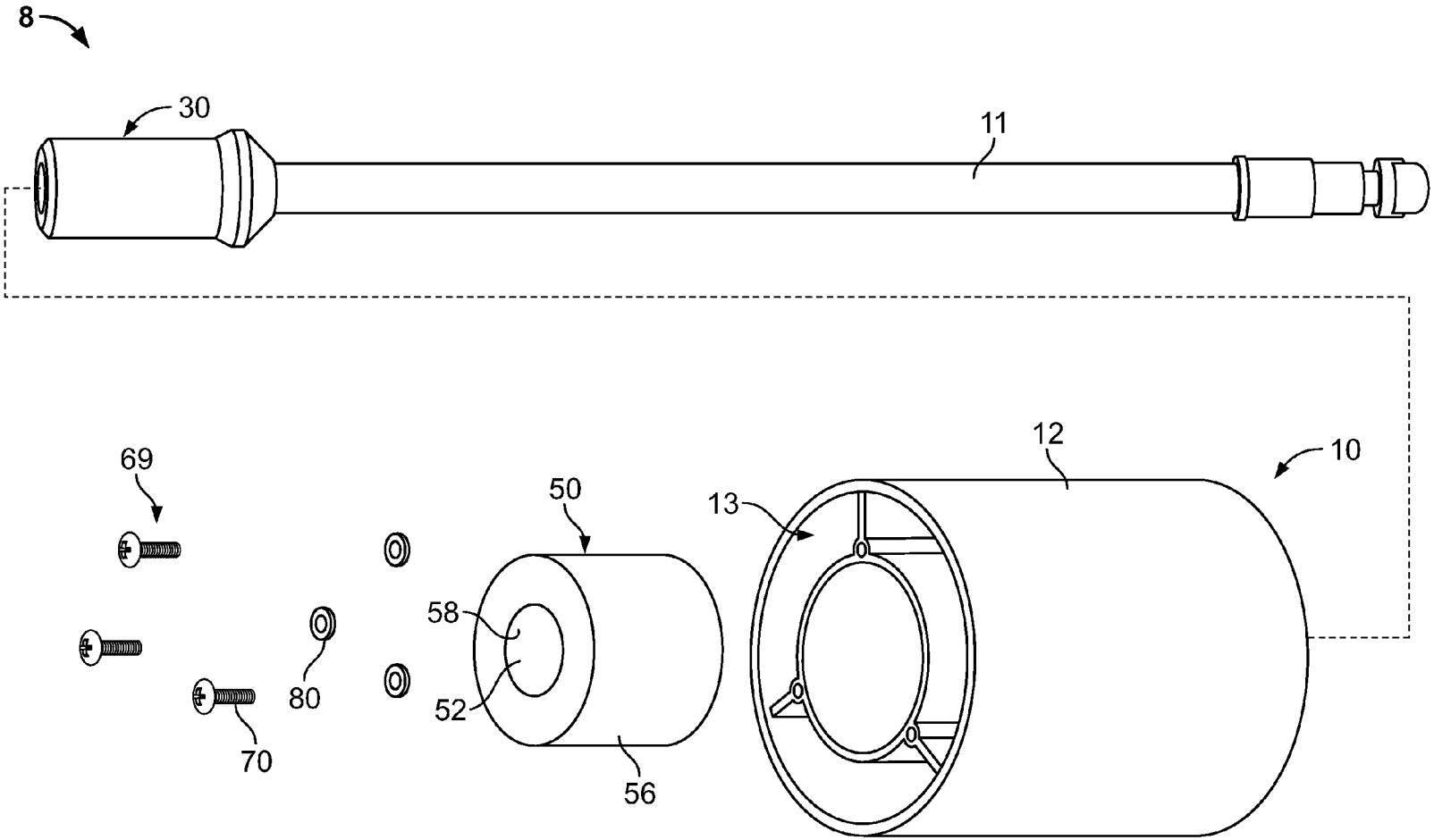
FIG. 2 is an exploded view of the assembly of FIG. 1.

Referring to FIGS. 1 and 2, a golf cup and flag pole assembly 8 is illustrated. In one form, the assembly 8 includes a plastic golf cup hole liner 10 and a flag pole 11, which can be used in a golf green, putting area, or the like. The golf cup hole liner 10 includes a generally cylindrical hole liner tube 12 defining a golf ball receiving space 13. The tube 12 has a generally inclined, conical region 14 extending inwardly to the space 13, which defines a plurality of openings 16. The conical region 14 typically has three to four openings 16 to permit water and debris to fall through to the bottom of the tube 12, but it should be understood that the conical region 14 may feature any number of openings 16. In the center of the conical region 14, a ferrule receiving hole 18 is defined through which a ferrule 30 passes when inserted into the golf cup hole liner 10. Extending downwardly from the conical region 14 is an annular retention wall 20, which defines an annular pocket 22. Received in the annular pocket 22 is an insert or coupling member 50, which is preferably formed from the same material as the ferrule 30. The liner tube 12 and the retention wall 20 are depicted with walls that are generally vertical, but it will be appreciated that they may have a slight draft angle, particularly if they are fabricated using injection molding techniques. In a preferred form, the golf cup hole liner 10 is composed of plastic, but it will be appreciated that it may be formed of metal, for example aluminum.

Figure 3:
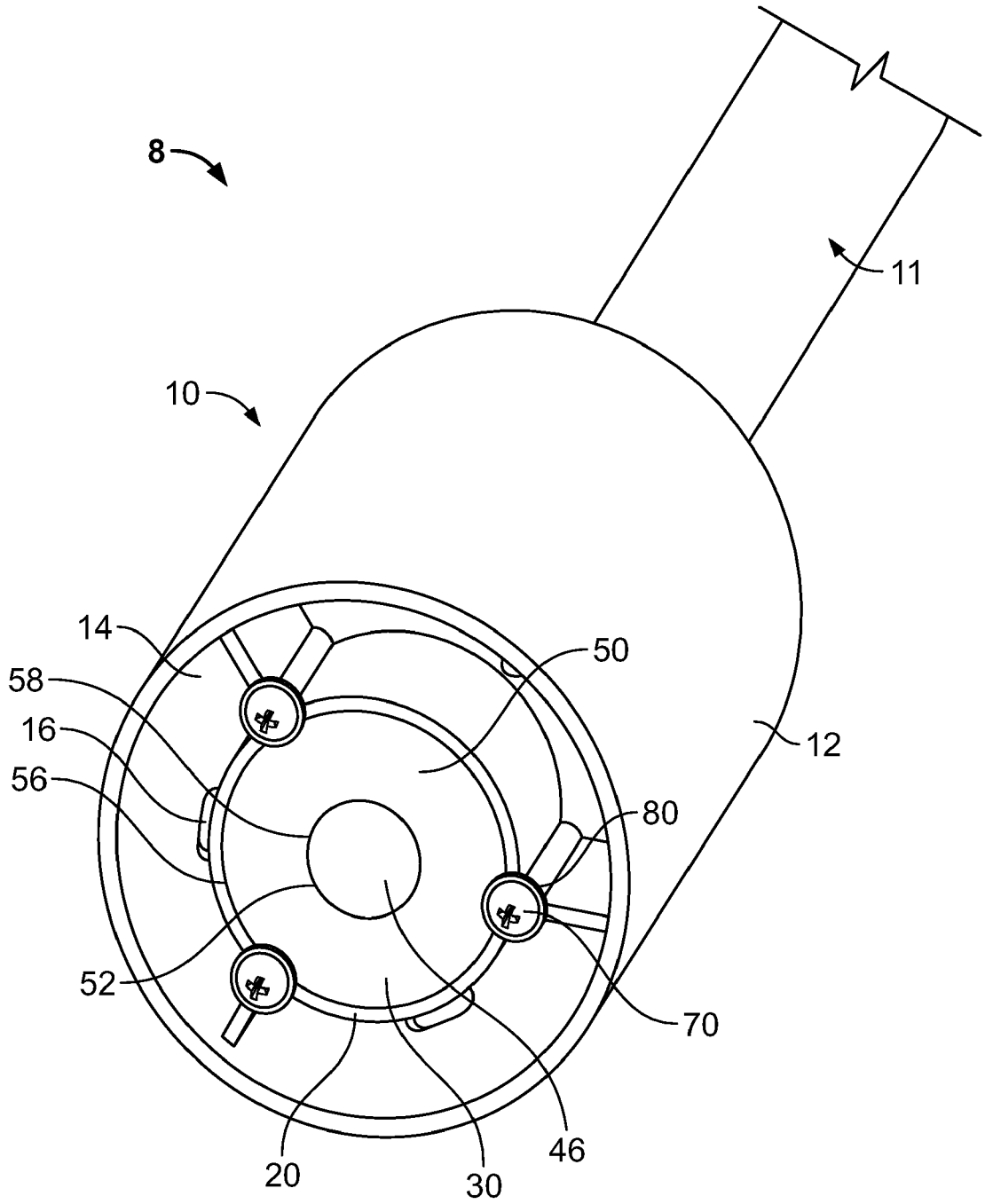
FIG. 3 is a perspective view of the assembly of FIG. 1.
Figure 4:
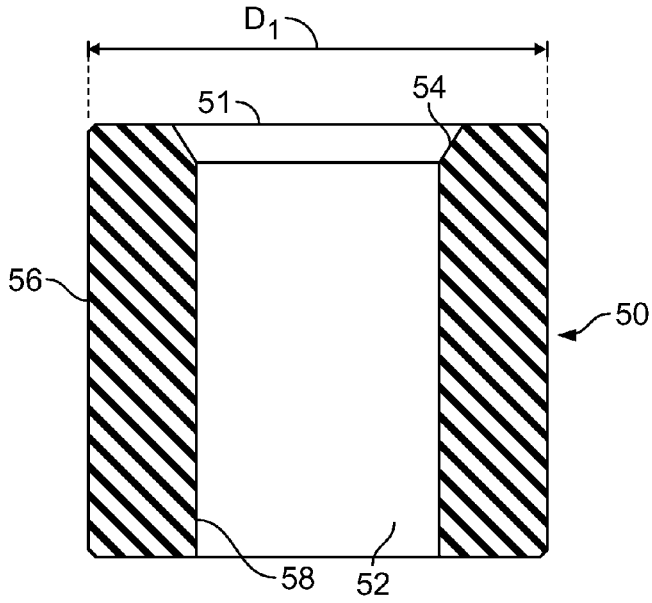
FIG. 4 is a cross-sectional view of an exemplary coupling member for use in the assembly of FIG. 1.

Turning now to FIGS. 2-4, one form of the coupling member 50 is illustrated in more detail. In such form, the coupling member 50 is an annular insert, having an outer wall 56 and an inner wall 58 defining a bore 52 extending through the coupling member. A first or upper end 51 of the bore 52 terminates in a chamfer 54, which is inclined outwardly to complement a corresponding surface 40 on the ferrule 30 (i.e., FIG. 5). As further described below, the coupling member 50 is preferably formed from a non-metallic material such as ceramic, and most preferably a ceramic composite material.

In use, the coupling member 50 is received in the annular pocket 22 such that the outer wall 56 of the coupling member 50 is adjacent with the annular retention wall 20 of the tube liner 12. Preferably, the coupling member 50 is inserted into the pocket 22 from the bottom of golf cup hole liner 10 and retained therein by at least one fastening member 69. As illustrated in FIGS. 2 and 3, one exemplary form of the fastening member 69 is a plurality of screws 70 and washers 80. Although three screws and washers are shown, it will be appreciated that the coupling member 50 could be retained within the pocket 22 using any number of fastening members 69 or with different fastening methods, such as a friction-fit, clips, bolts, adhesive, glue, tape, flanges, and the like, so long as the fastening member 69 secures the coupling member 50 into the pocket 22. In one form, an outer diameter D1 (FIG. 4) of the coupling member 50 is larger than an inner diameter D2 (FIG. 1) of the ferrule receiving hole 18 such that the coupling member 50 may be fully seated within the pocket 22 using the fastening member 69, a lower surface 19 of conical region 14, and the retention wall 20.

Figure 5:
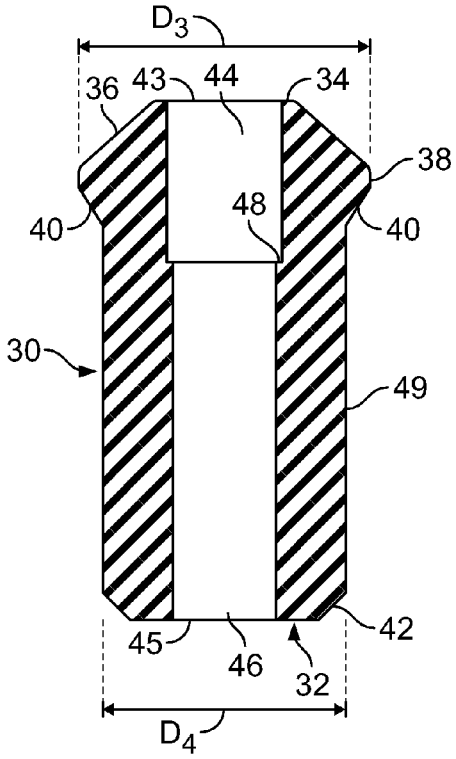
FIG. 5 is a cross-sectional view of an exemplary ferrule for use in the assembly of FIG. 1.

Turning now to FIG. 5, one form of the ferrule 30 is shown in more detail. The ferrule 30 is preferably an elongate cylindrical member configured to slide through the receiving hole 18 of the liner 12 and be removably inserted into the bore of the coupling member 50. To facilitate its insertion into the coupling member bore 52, the ferrule 30 preferably transitions from a lower end 32 to an annular side wall 49 via an outer chamfered edge 42. In use, the chamfer 42 aids in guiding the ferrule 30 through the hole 18 and then further into the bore 52 of the coupling member 50 (i.e., FIG. 6). When inserted in the coupling member 50, the ferrule 30 comes to rest when the lower angled surface 40 of the ferrule 30 comes into contact with the coupling member chamfer 54. The chamfer 54 and the lower angled surface 40 are preferably complementary to one another forming an interface between the ferrule 30 and coupling member 50 that is generally inclined relative to the bore 52 to generally increase the ferrule 30 stability in the cup 10.

The angled surface 40 also forms an annular extension or lip 38 on the ferrule 30. For example, the lower angled surface 40 inclines outwardly from the side wall 49 forming the annular lip 38 where the ferrule 30 has an outer diameter D3 larger than an outer diameter D4 of the side wall 49 (FIG. 5). Above the lip 38, an upper angled surface 36 transitions inwardly to a top end 34 of the ferrule 30. The top end 34 defines a first opening 43 of a first or upper bore 44. The bottom end 32 of the ferrule 30 defines a second opening 45 of a second or bottom bore 46. A lower portion of the flag pole 11 is preferably inserted a distance into the first bore 44 of the ferrule 30. In a preferred form, the ferrule 30 and flag pole 11 are bonded using epoxy glue, however, it will be appreciated that the flag pole 11 and the ferrule 30 may be assembled by an adhesive, fastener, friction-fit, or any other suitable method to connect a ferrule and flag pole.

The first bore 44 extends into the ferrule 30 and preferably terminates in an inwardly extending annular lip 48, upon which the flag pole 11 may come to rest when inserted into the bore 44. The ferrule 30 also preferably includes the second or bottom bore 46 so that any loose debris that may have fallen into the golf hole cup 10 can be pushed or trapped into the bore 46 when the ferrule 30 is inserted into the coupling member 50. In this way, any loose debris will have less opportunity to impede the entry of the ferrule 30 because such debris will be received in the bore 46 rather than between the ferrule 30 and the coupling member 50. As a result, the ferrule 30 will be more likely to achieve the desired quality of contact with the coupling member 50. A preferred embodiment has the bore 46 in direct connection with the bore 44, with the transition between the two defined by the annular lip 48, but it will be appreciated that the relative depths of these bores could vary and that the bores 44 and 46 may not connect at all (i.e., they may have a segment of material between them). It will also be appreciated that the bore 46 may not be present in certain embodiments of the ferrule 30.

In a preferred form, both the ferrule 30 and the coupling member 50 are constructed from substantially the same non-metallic material such as a ceramic, and preferably substantially the same ceramic composite material. In one embodiment, the ferrule 30 and coupling member 50 are formed primarily from an aluminum oxide ($Al_2O_3$) composite, such as aluminum oxide composites provided by CerCo, LLC (Shreve, Ohio), but it will be appreciated that the composite material could also contain zirconium oxide, silicon nitride, and/or mixtures thereof. The ceramic material may also include a minor component or secondary material. For example, the minor component may include any mineral within the spinel class of minerals, another crystalline material, or an amorphous (i.e., noncrystalline). For example, the minor component may be $MgAl_2O_4$. For purposes herein, spinel refers to a class of minerals which crystallize in the isometric system with an octahedral habit.

Ferrules and coupling members constructed from the same ceramic materials have many advantages over the conventional metals or plastics used to construct ferrules and receiving holes of the prior art. Preferred composites for the ferrules and coupling members described herein have Vickers hardness numbers in excess of about 980HV5 (kg/mm$^2$), which is generally hard enough to substantially resist damage from any debris, rock, sand, and the like found on a golf course or putting environment. Preferred materials also exhibit a tensile strength of about 18 kpsi or greater (ACMA Test #4) and a compressive strength of 235 kpsi or greater (ASTMC-773-74). Rather than being scratched or damaged by debris, the ceramic ferrules and coupling members described herein preferably crush or pulverize any debris trapped between them generally due to the hardness of the ceramic material used to form the ferrule and coupling member. In addition, the preferred composites are generally chemically inert and generally pose little variation upon exposure to moisture or temperature gradients. In addition, because the ferrule 30 and coupling member 50 are of the same non-metallic materials, they are generally not subject to galvanic corrosion.

Figure 6:
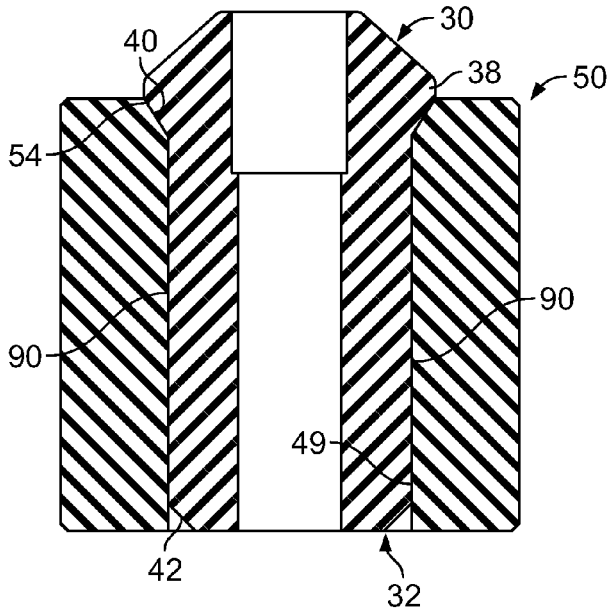
FIG. 6 is a cross-sectional view of the ferrule and coupling member shown coupled together.

The ferrule 30 and coupling member 50 formed from ceramic composites may also be fabricated to greater tolerances than their metal and plastic counterparts. Prior metal/plastic ferrules and cup receiving holes, for example, feature tolerances that generally create a gap of about 0.030 to about 0.050 inches or greater therebetween when assembled. On the other hand, the ferrule 30 and coupling member 50 formed from the above-described ceramic materials may be fabricated to have a gap 90 of only about 0.005 to about 0.010 inches between the coupling member inner wall 58 and the side wall 49 of a coupled ferrule 30 (FIG. 6). The smaller gap 90 together with the hardness of ceramic composite material generally permits the ferrule 30 to enter the coupling member 50 and push out, crush, or pulverize any particles or debris that could otherwise lodge between the two and scratch or damage the surfaces therein. The smaller gap 90 also allows the ferrule side wall 49 and the coupling member inner wall 58 to have more substantial contact and generally enable the flag pole 11 to remain upright even in windy conditions.

In addition to increased tolerances, the use of ceramic materials for the ferrule 30 and coupling member 50 also permits a smoother surface than prior plastic and metal components. For example, the ferrule side wall 30 and/or the coupling member inner wall 58 may have a surface finish of about 16 RMS or less, which is smoother than most machined or cast metal and many processed plastics (i.e., a typical metal ferrule has a surface finish of about 20 to 40 RMS). This smooth surface finish permits the ferrule 30 to slide in and out of the bore 52 of the coupling member 50 with low friction and in some cases minimize, and preferably eliminate, sticking or galling of the ferrule in the hole liner.

Thus, the golf cup and flag pole assembly 8 allows the ferrule 30 to easily slide in and out of the coupling member 50 with minimal, if any, sticking. At the same time, the embodiments herein minimize, and preferably eliminate, scratching, corrosion, or other damage because the ferrule 30 and coupling member 50 have a relatively tight gap 90 therebetween and because they are both hard enough to generally prevent debris from damaging the ferrule 30 and the coupling member 50. The small gap 90 also allows substantial contact between the ferrule 30 and the coupling member 50 to form a more desirable level of stability for flag pole 11. The chamfer 54 and the angled contact surface 40 further provide additional stability. Thus, the embodiments herein generally keep the ferrule stable and allow it hold the flag pole 11 straight even in the presence of wind, moisture, or debris.

While embodiments of the described apparatus have been described in the foregoing, it will be understood that other details, materials, and arrangements of parts and components are possible which are within the scope of the claims and are intended to be included herein.

What is claimed is:

1. A golf cup and flag pole assembly comprising:

a golf cup hole liner;

a flag pole having a ceramic ferrule on an end thereof, the ceramic ferrule defining a bore to support the flag pole therein;

a ceramic coupling member positioned in the golf cup hole liner and configured to support the ceramic ferrule of the flag pole;

the ceramic ferrule and the ceramic coupling member formed of a substantially similar ceramic material including an aluminum oxide composite having a Vickers hardness of about 980HV5 or greater and a surface roughness of about 16 RMS or less; and wherein a supported ceramic ferrule includes a ceramic-to-ceramic interface between the ferrule and coupling member.

2. The assembly of claim 1, wherein the interface comprises a gap of less than about 0.010 inches between the ceramic ferrule and the ceramic coupling member.

3. The assembly of claim 1, wherein the ceramic coupling member is an annular member defining a bore therethrough sized to slideably receive at least a portion of the ceramic ferrule therein.

4. The assembly of claim 1, wherein the golf cup hole liner defines a pocket sized to receive the ceramic coupling member therein.

5. The assembly of claim 4, wherein the ceramic coupling member is secured in the pocket with at least one fastening member.

6. The assembly of claim 5, wherein the pocket is defined by an annular wall.

7. The assembly of claim 6, wherein the at least one fastener is secured to an end of the annular wall.

8. A golf hole cup liner and flag pole assembly comprising:

a ceramic insert defining a bore therethrough disposed in the golf cup hole liner;

a ceramic ferrule positioned on an end of the flag pole and configured to be slideably received in the bore of the ceramic insert, the ceramic ferrule having opposite ends and having a first opening defined by an inner wall at one end of the ceramic ferrule to receive the flag pole end therein and a second opening defined by another inner wall at the other end of the ceramic ferrule to form an open cavity for receiving debris therein when the flag pole is inserted into the bore of the ceramic insert; and wherein the ceramic insert and the ceramic ferrule are constructed from substantially the same non-metallic aluminum oxide composite having a Vickers hardness of at least about 980HV5.

9. The assembly of claim 8, wherein the non-metallic material has a tensile strength of at least about 18 kpsi and a surface finish of about 16 RMS or less.

10. The assembly of claim 8, wherein at least a portion of an outer diameter of the ferrule is smaller than an inner diameter of the insert bore such that a gap therebetween is less than about 0.010 inches.

11. The assembly of claim 8, further comprising a chamfered edge defining an opening to the insert bore on one end thereof, the chamfered edge to increase the stability of a received ferrule.

12. The assembly of claim 11, wherein the ferrule has an inclined surface configured to contact the chamfered edge of the insert when received in the bore.

13. The assembly of claim 8, further comprising an inwardly sloped chamfer at one end of the ferrule to generally guide the ferrule into the insert bore.

14. The assembly of claim 8, further comprising a fastener to secure the insert in the golf cup hole liner.

15. The assembly of claim 8, wherein the golf cup hole liner includes a retaining wall defining a pocket sized and configured to receive the insert therein.

* * * * *